US009309641B2

(12) United States Patent
Burkhardt

(10) Patent No.: US 9,309,641 B2
(45) Date of Patent: Apr. 12, 2016

(54) ADJUSTABLE MOUNT FOR POSITIONING A COFFER DAM

(71) Applicant: Gregory B Burkhardt, Lusby, MD (US)

(72) Inventor: Gregory B Burkhardt, Lusby, MD (US)

( * ) Notice: Subject to any disclaimer, the term of this patent is extended or adjusted under 35 U.S.C. 154(b) by 0 days.

(21) Appl. No.: 14/155,342

(22) Filed: Jan. 14, 2014

(65) Prior Publication Data

US 2015/0197911 A1 Jul. 16, 2015

(51) Int. Cl.
*E02D 19/04* (2006.01)

(52) U.S. Cl.
CPC ..... *E02D 19/04* (2013.01)

(58) Field of Classification Search
CPC ..... E02D 5/60; E02D 19/04
USPC ..... 405/11–14
See application file for complete search history.

(56) References Cited

U.S. PATENT DOCUMENTS

| | | | | | |
|---|---|---|---|---|---|
| 3,197,968 | A | * | 8/1965 | Castellanos | 405/11 |
| 3,331,211 | A | * | 7/1967 | Val Cravens Du et al. | 405/12 |
| 3,768,265 | A | * | 10/1973 | Brouillette | 405/12 |
| 4,184,790 | A | * | 1/1980 | Bassett | 405/225 |
| 4,211,503 | A | * | 7/1980 | Peterson et al. | 405/211.1 |
| 4,991,996 | A | * | 2/1991 | Tate | 405/14 |

* cited by examiner

*Primary Examiner* — Tara M. Pinnock
(74) *Attorney, Agent, or Firm* — William H. Holt

(57) ABSTRACT

Apparatus including fluid motors and a pair of collars for adjustably mounting a coffer dam upon a piling by assembling equipment while operating above the water line thereby avoiding the need for underwater divers to perform dangerous underwater operations. Also included are a plurality of scrapers that are biased against the piling for removing accumulated detritus during upward and downward movement of the scrapers upon the piling.

5 Claims, 4 Drawing Sheets

ADJUSTABLE MOUNT FOR POSITIONING A COFFER DAM

BACKGROUND OF THE INVENTION

The present invention is a novel innovation to be used with my earlier invention entitled "Coffer Dam for Servicing Marine Structures", as disclosed in U.S. Publication No. 2010/0189503 A1 on Jul. 29, 2010. The coffer dam is mounted upon a piling of a marine structure, partly above and partly below the water line, and provides a support surface and protected area for workmen to repair, renovate and recondition the piling where damage has occurred in the area above and below the water line. Heretofore, assembly of the coffer dam upon the pining, and removal therefrom, required a diver to perform dangerous work under water during assembly and disassembly of the coffer dam upon the piling.

SUMMARY OF THE INVENTION

The present invention includes a plurality of collars for encircling the piling and a plurality of fluid motors, either hydraulic or pneumatic for sequentially raising and lowering the collars and ancillary parts of the coffer dam to position it upon the piling all while working above the water line without any need for a diver to perform underwater procedures.

DESCRIPTION OF THE PREFERRED EMBODIMENT

Figure 1:
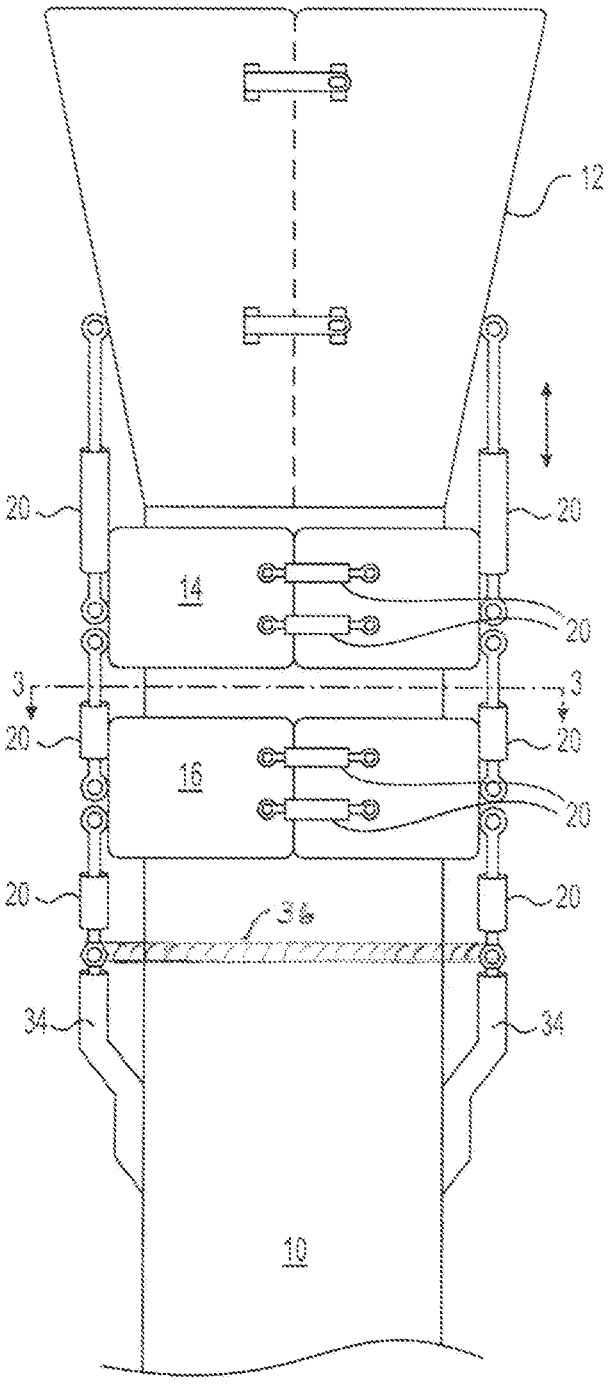
FIG. 1 is an elevation view showing essential elements of the present invention including a plurality of collars capable of being adjustably positioned upon a piling, and also including a plurality of scraper members movable therewith.

FIG. 1 illustrates a cylindrical piling 10 typically used for supporting marine structures such as wharves, or drilling platforms, and the like (not shown.) Depending upon the water quality and type, i.e., salt water, fresh water, brackish water, etc., and the motion of the water, i.e., tidal, lake, or flowing stream, if becomes necessary to repair and refurbish the piling 10 in order to extend its life. As disclosed in my earlier filed U.S. Patent Application identified above (see FIG. 6), a coffer dam is mounted upon and encircles the piling for providing a protective environment for a worker who can remove damaged portions of the piling and make suitable repairs.

Figure 6:
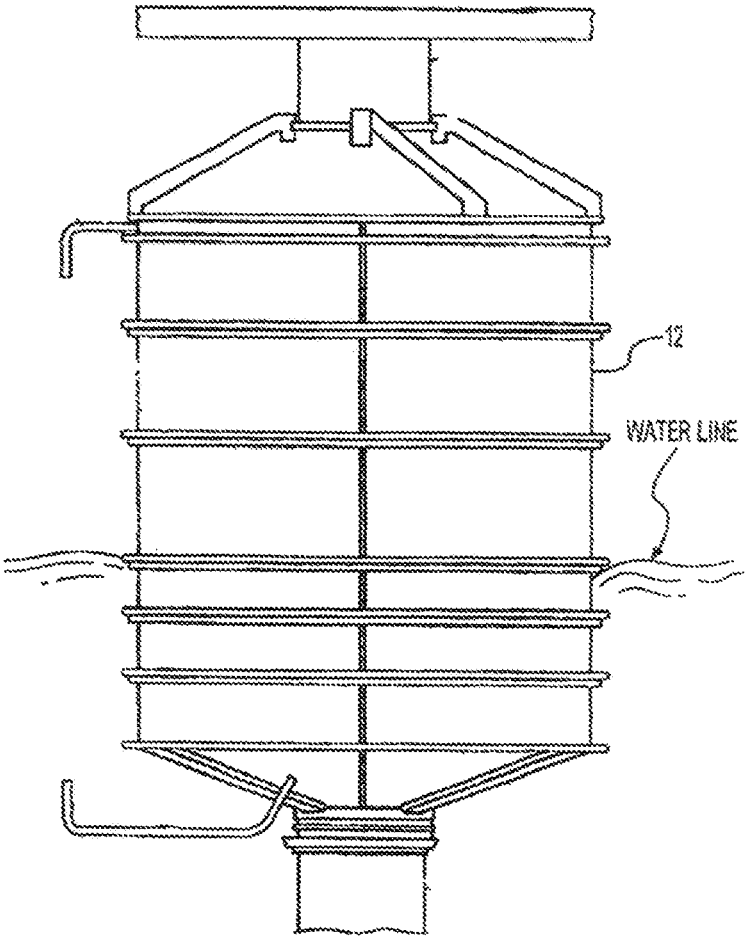
FIG.6 PRIOR ART
FIG. 6, considered as Prior Art, corresponds to FIG. 2 in the above mentioned publication, U.S. Publication No. 2010/0189503 A1, of my earlier invention and shows a coffer dam positioned upon a piling end expending above and below the water line.

FIG. 6 illustrates a coffer dam mounted upon a piling in accord with my earlier invention and shows portions above and below the surrounding water line. FIG. 1, at the upper portion thereof shows a funnel-shaped member 12 which in a bottom portion of a coffer dam comparable to the showing in FIG. 6 and circumscribes the piling 10.

Figure 2:
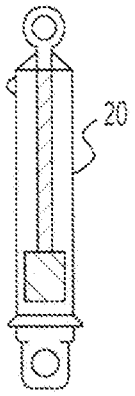
FIG. 2 is a view, partly in section, of a conventional hydraulic or pneumatic fluid motor used in the invention.

As shown in FIG. 1, located below the member 12 and circumscribing the piling 10 are two collar members 14 and 16 which are operatively connected to each other and to the member 12 by a plurality of fluid motors 20, a typical one being shown in FIG. 2. If is to be understood that the fluid motors 20 are conventional piston and cylinders which may be operated with hydraulic or pneumatic fluids and will be of selective sizes depending upon their design function of securing parts together and/or adjustably position parts along the piling 10 as will be further described.

Figure 3:
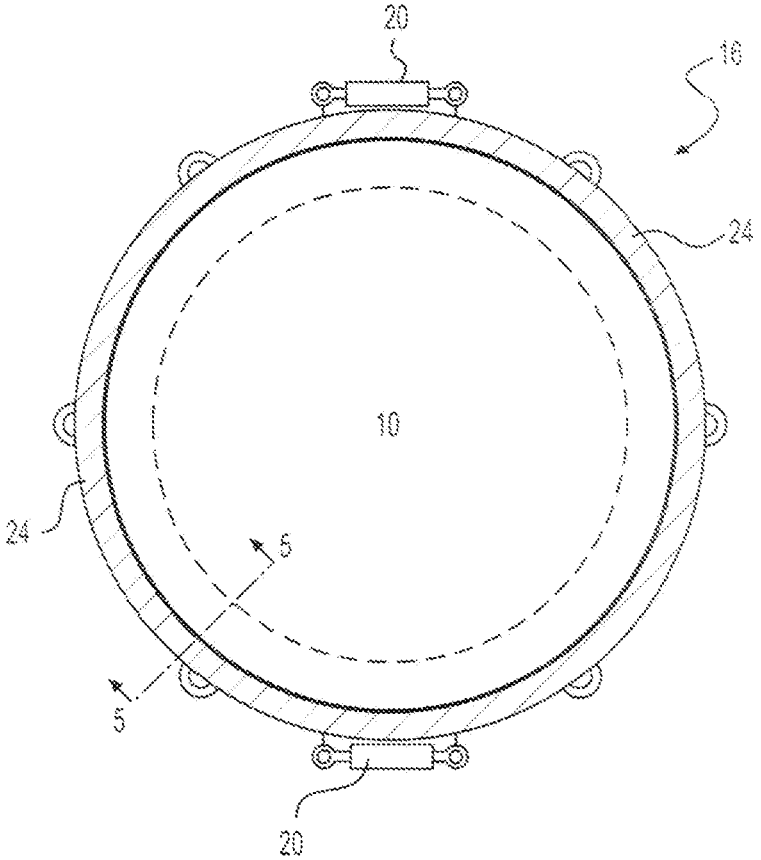
FIG. 3 is a horizontal sectional view taken on line 3-3 of FIG. 1.
Figure 4:
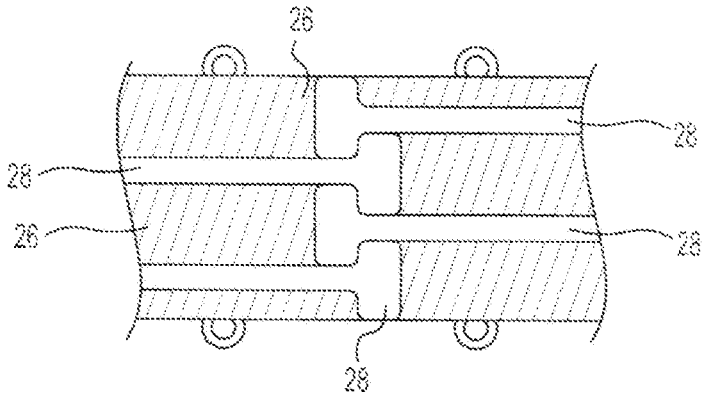
FIG. 4 is a fragmentary view of a rubber seal that lines the interior surface of a collar member.
Figure 5:
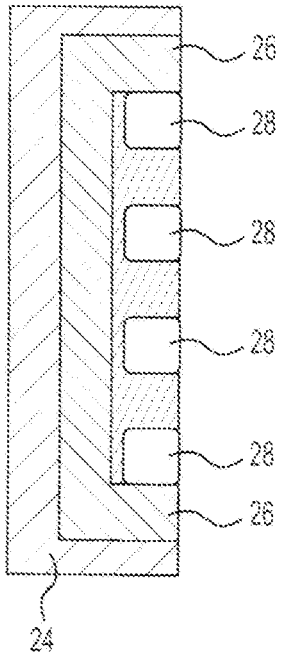
FIG. 5 is a sectional view taken on line 5-5 of FIG. 3 showing a metal collar member and an enclosed rubber seal containing openings receiving a series of tubular members that are inflatable for securing the respective coller member to the piling for supporting the coffer dam in the desired position.

Collars 14 and 16 are comprised of arcuate sections which circumscribe the piling 10 and are held in place by fluid motors 20 as is best shown in FIGS. 1 and 3. Each of the cellars are comprised of arcuate metal ring members 24, as boat shown in FIGS. 3 and 5, and preferably comprised of stainless steel. As is shown in FIGS. 4 and 5, the ring members 24 are lined along the interior surface with a heavy duty rubber or other elastomeric lining 26, which has portions 28 removed for receiving sealing members such as inflatable pneumatic tubes 28. It is to be understood that the tubes 28 are provided with conventional valves and are to be connected to fluid lines and conventional pumps for being operated by being inflated or deflated at will.

Referring again to FIG. 1, a plurality of scraper members 34, only a pair being shown for clarity, circumscribe the piling 10. The bottom edges of scrapers 34 are slightly curved or arcuate in shape to correspond to the curvature of the particular piling 10. A tension spring member 36 biases the scrapers 34 against the piling 10 for aiding in removing built-up debris from the piling as part of the cleaning and repairing operation.

A particularly important feature of the invention is that the various components, i.e., the scrapers 36, collars 14 and 16, fluid motors 20, funnel member 12 and related coffer dam secured above the funnel member 12, are assembled upon the piling 10 by crew members operating above the water line, thereby avoiding the previous need of having divers work while submerged in the water. The collars 14 and 16, including the fluid centers 20 and the pneumatic tubes 28 are sequentially operated such that by securing the collar 16 to the piling 10 the scrapers 34 can be lowered by the related fluid motors, while the seller 14 and funnel member 12 can be raised, or lowered, to a desired position. Likewise, coller 14 can be secured to the piling 10 and the fluid motors can be operated to raise and lower the scrapers 34, collar 16 and funnel member 12.

While the invention has been described, in connection with a preferred embodiment, it is not intended to limit the scope of the invention to the particular form set forth. On the contrary, it is intended to cover such alternatives, modifications and equivalents as may be included within the spirit and scope of the inversion as defined by the appended claimed subject matter.

The invention claimed is:

1. Apparatus for adjustably positioning a coffer dam upon a piling, said apparatus including a pair of vertically spaced collars for encircling a piling and being operatively connected to each other by a plurality of fluid motors vertically arranged for selectively raising and lowering said collars relative to each other;

said collars being comprised of arcuate sections for circumscribing the piling;

and inflatable means disposed within said arcuate members for alternatively securing and releasing said arcuate members to and from the piling.

2. Apparatus as defined in claim 1 wherein said inflatable means are comprised of a plurality of pneumatic tubes inflated for securing said collars to the piling and deflated to release said collars from the piling during movement of said collars upwardly and downwardly on the piling by said fluid motors.

3. Apparatus as defined in claim 2 wherein said vertically spaced collars are comprised of metal ring members, said ring members being lined along the interior surface thereof with an elastomeric lining, and said lining has portions removed for receiving said pneumatic tubes therein.

4. Apparatus as defined in claim 1 including a plurality of fluid motors connected between the upper of said vertically spaced collars and said coffer dam for adjustably positioning said coffer dam on the piling.

5. Apparatus as defined in claim 1 including a plurality of scraper members for encircling the piling, means for biasing said scraper members against the piling for removing accumulated detritus during upward and downward movement of said scraper members along the piling, and a plurality of fluid motors connecting said scraper members to the lowermost of said vertically spaced collars, for moving said scraper members relative to the piling.

* * * * *